United States Patent [19]

Fine et al.

[11] 4,214,533

[45] Jul. 29, 1980

[54] ANNULAR ALTERNATOR FOR ARTILLERY

[75] Inventors: Jonathan E. Fine, Silver Spring, Md.; Clinton J. Sewell, Beloit, Kans.

[73] Assignee: The United States of America as represented by the Secretary of the Army, Washington, D.C.

[21] Appl. No.: 911,750

[22] Filed: Jun. 2, 1978

[51] Int. Cl.[3] ..... F42C 11/04

[52] U.S. Cl. ..... 102/209; 310/263

[58] Field of Search ..... 102/209, 208; 310/67 R, 310/156, 66, 159, 164, 263

[56] References Cited

U.S. PATENT DOCUMENTS

| | | | |
|---|---|---|---|
| 2,212,192 | 8/1940 | Howell | 310/263 |
| 2,511,872 | 6/1950 | Parker | 102/208 |
| 2,680,407 | 6/1954 | Clark | 102/208 |
| 3,437,897 | 4/1969 | Lenny | 310/156 |
| 3,553,510 | 1/1971 | Howey et al. | 310/263 |
| 3,678,311 | 7/1972 | Mattingly | 310/156 |
| 3,772,992 | 11/1973 | Moore et al. | 102/208 |
| 3,999,092 | 12/1976 | Whiteley | 310/156 |
| 4,004,519 | 1/1977 | Hopkins | 102/208 |
| 4,095,129 | 6/1978 | Tanai et al. | 310/156 |
| 4,138,617 | 2/1979 | Sudler | 310/156 |

*Primary Examiner*—Charles T. Jordan

*Attorney, Agent, or Firm*—Nathan Edelberg; Robert P. Gibson; Saul Elbaum

[57] ABSTRACT

An annular alternator for use with a fuze ogive having an annular rotor with alternating magnetic poles and an annular stator coil enclosed by a highly magnetically permeable toroid having spaced interdigitating poles on the surface adjacent the magnetic poles.

5 Claims, 3 Drawing Figures

FIG. 1
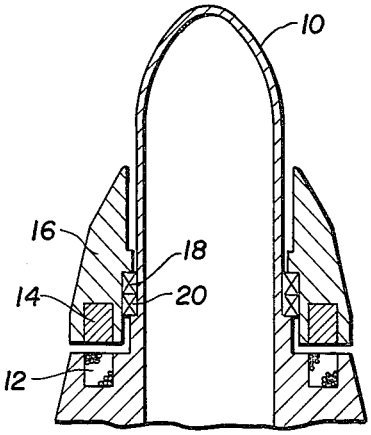
FIG. 2
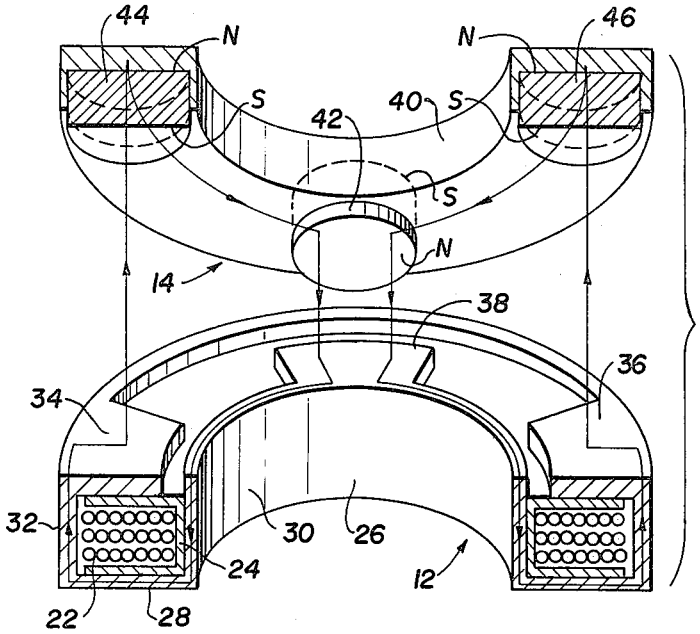
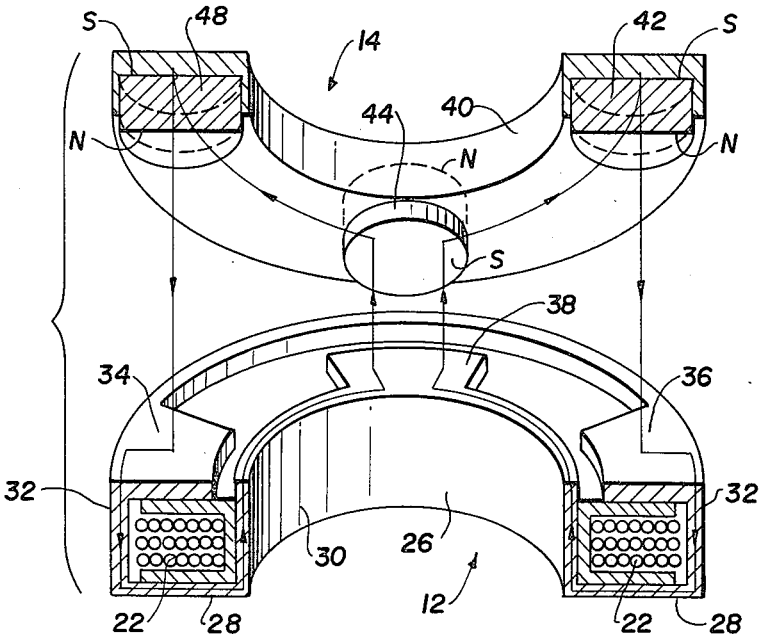
FIG. 3

ANNULAR ALTERNATOR FOR ARTILLERY

RIGHTS OF THE GOVERNMENT

The invention described herein may be manufactured, used, and licensed by or for the United States Government for governmental purposes without the payment to us of any royalty thereon.

BACKGROUND OF THE INVENTION

The present invention relates generally to alternators and more specifically to an annular alternator structure.

DESCRIPTION OF THE PRIOR ART

MIL-STD-1316A requires new ammunition to have two independent signatures, such as set back and spin forces. For non-spinning rounds such as mortars, bombs, and some artillery projectiles, velocity in flight can be used as a second signature. An alternator has been developed for the M734 Multi-Option Fuze for Mortars which uses ram air to provide electrical energy and mechanical energy of rotation to arm the fuze. This alternator is mounted within the fuze and the air is conducted to its turbine by a means of an outlet duct on the nose. The size of this alternator does not make for practical use in the confined space of the five inch and eight inch Navy artillery projectile. Thus there exists a need for an alternator which provides electrical power and spin signature which can be incorporated into the confined space available in the five and eight inch Navy artillery projectile.

SUMMARY OF THE INVENTION

The present invention provides an annular alternator capable of being incorporated into a confined space and capable of providing the electrical power needed. The alternator includes an annular rotor having magnetic poles alternating around the circumference thereof and an annular stator having a coil for receiving the magnetic flux produced by the rotating magnetic poles and producing a current in the coil. The coil is surrounded by a high magnetically permeable toroid having a discontinuous surface opposite the magnetic poles. The toroid includes a plurality of interdigitating spaced poles extending across the discontinuous surface. The rotor and stator may be juxtaposed along the axis of rotation or may be concentric. The magnetic poles may be a plurality of spaced permanent magnets in a high magnetic permeable keeper or an equivalent continuous magnetic material.

For use in artillery, the stator is part of the fuze ogive and the rotor is mounted by bearings on the exterior surface of the ogive. The rotor includes vanes to rotate the rotor relative to the ogive by gases traversing the ogive. Samarium cobalt magnets provide the needed 15 watts at 25,000 rpm for a fuze element.

OBJECTS OF THE INVENTION

An object of the present invention is to provide an inexpensive power source and second signature for our artillery rounds.

Another object is to provide an annular alternator capable of providing a large amount of power.

A further object of the invention is to provide an alternator providing the power needed within the space restriction of five inch and eight inch Navy artillery projectiles.

A still further object of the invention is to provide an alternator capable of being externally mounted to a fuze ogive.

Other objects, advantages, and novel features of the invention will become apparent from the following detailed description of the invention when considered in conjunction with the accompanying drawings.

BRIEF DESCRIPTION OF THE DRAWINGS

FIG. 1 is a schematic cross-sectional view of an annular alternator according to the principles of the present invention mounted to the exterior of a fuze ogive.

FIG. 2 is an exploded cross-sectional view of an alternator incorporating the principles of the present invention illustrating the magnetic flux path at a first angular position.

FIG. 3 is an exploded cross-sectional representation of the principle of an alternator incorporating the principles of the present invention illustrating the magnetic flux path at an angular position 90° from the angular position of FIG. 2.

DESCRIPTION OF THE PREFERRED EMBODIMENTS

FIG. 1 illustrates a schematic cross section of a fuze ogive 10 having a stator 12 embedded therein. A rotor 14 which is mounted to a housing having vanes 16 is mounted to the ogive 10 by a pair of bearing surfaces 18 and 20. Rotor 14 and vanes 16 encompass the ogive 10 and require no modification to the ogive except for a bearing element 18. The vanes 16 make use of the plentiful air flow past the projectile in the flight velocity range of 800 to 2,500 feet per second to despin the vanes 16 and rotor 14 relative to the spinning ogive 10 and the projectile upon which it is mounted. The specific fuze elements are not shown for sake of simplicity and it should be noted that electrical connection between the stator coil and the fuze is obvious.

Although being designed for five inch and eight inch Navy projectile rounds, the annular alternator of the present invention may be used with bombs, rockets, and spinning and non-spinning artillery projectiles and submarine launched missiles which travel exclusively in air wherein the rotor is mounted externally to the projectile. Also the annular alternator may be used as a power source in any application desirable.

The specific structure of the annular alternator is illustrated in FIG. 2. The stator 12 includes a coil 22 wound around a bobbin 24 to have an annular shape. A high magnetically permeable casing 26 of toroid shape surrounds the coil 22 and bobbin 24. The toroid 26 includes continuous bottom wall 28 continuous interior wall 30 and continuous exterior wall 32. The top wall is discontinuous and includes, for example, four interdigitating poles extending alternately from interior and exterior walls 30 and 32 across the discontinuous surface. As illustrated, these interdigitating poles include poles 34 and 36 extending from the exterior wall 32 and spaced from interior wall 30 and pole 38 and a fourth pole (not shown) extending from interior wall 30 and spaced from exterior wall 32. Only half of poles 34 and 36 are shown. The bobbin 24 may be, for example, a nylon bobbin, and the toroid 26 may be a high magnetically permeable material, for example, Permalloy 49.

The rotor being annular in shape includes a highly permeable keeper 40 of, for example, Permalloy 49, having four alternating magnetic poles. The alternating magnetic poles may be permanent magnets illustrated in FIG. 2 and as permanent magnets 42, 44, 46 and 48. The north pole of magnets 42 and 48 are shown as extending down from the keeper 40 whereas the south pole of the half illustrated magnets 44 and 46 are shown extending down from the surface of the keeper 40. Samarium cobalt magnets were found to produce the required 15 watts at 25,000 rpm while producing over 20 watts above 30,000 rpms. Other magnets may be used, for example, barriumferrite magnets and Alnico 5-7. Although the latter two magnets are considerably less expensive, they are also more sensitive to the displacement or distance between the rotor and stator. Thus the Samarium cobalt magnets are preferred. Although the rotor is shown as comprising four permanent magnets in a high magnetically permeable keeper, the magnets and keeper may be replaced by bar or other shaped magnets to provide the equivalent alternating pole configuration.

The magnetic circuit illustrated in FIG. 2 will be considered a zero degree angular position of the rotor relative to the stator. Beginning at magnet 42 the magnetic flux from the north pole of magnet 42 is transmitted to stator pole 38 around the interior wall 30 of the stator to bottom wall 28 below poles 34, 36 respectively and up the exterior wall 32 on to stator poles 34 and 36. The flux from the stator continue to the south pole of magnets 44 and 46 respectively. The flux then travels from the south pole to the north pole of magnets 44 and 46 and there back to the south pole and then to the north pole of magnet 42. Magnet 48 (not shown) in FIG. 2 produces a mirror image flux path. The path produced in FIG. 2 moves from the interior wall 30 to the exterior wall 32 thus traverses or cuts the coil 22 in one specific direction to produce a voltage therein of a specific value and polarity.

As rotor 14 rotates 90° relative to stator 12, the magnetic flux through the stator reverses to produce an equal magnitude and opposite polarity as illustrated in FIG. 3. Magnetic flux path is now from the north pole of magnet 42 and magnet 48 to the opposed stator poles 36, 34 respectively down the exterior wall 32 across the bottom wall 28 and up the interior wall 30 of the stator toroid 26 to the stator pole 38. The flux then travels from stator pole 38 to the south pole of magnet 44 to the north pole of magnet 44 through the keeper 40 to the south poles of magnets 42 and 48 respectively. As can be seen, the magnetic flux moves from the exterior wall 32 to the interior 30 and thus traverses the coil 22 in the opposite direction producing an opposite polarity voltage in the coil.

Thus the four pole stator and four pole rotor produced two AC cycles of voltage to every 360° of rotation. The number of stator poles and rotor magnetic poles may be varied to provide the desired output signal per 360° rotation, as well known in the alternator art, the essence being that the stator poles interdigitate from opposite walls of a toroid to provide the magnetic circuit and the rotor magnetic poles be of alternate polarity around the circumference. For example, the alternator could include two stator poles 180° apart and six rotor magnetic poles 60° apart. This specific number of poles on the rotor and stator are a matter of design.

As other examples, the alternator could have two stator poles 180° apart and two rotor magnetic poles 180° apart; six stator poles 60° apart and six rotor magnetic poles 60° apart; and eight stator poles 45° apart and eight rotor poles 45° apart. These are but a few of the possible combinations of interdigitated stator poles and alternating magnetic rotor poles.

The alternator illustrated in FIGS. 1-3 has an annular stator 12 and annular rotor 14 juxtaposed along the axis of rotation. The alternator may also be designed with an annular rotor 12 and annular stator 14 wherein the stator and rotor are concentric. In the concentric configuration, the stator poles 34, 36, 38 and the fourth pole are positioned either on the interior wall 30 or the exterior wall 32 of the toroid depending upon whether the rotor is interior or exterior the stator such that the interdigitizing stator poles are opposite the surface of the toroid adjacent the magnetic poles of the rotor.

From the preceeding description of the preferred embodiments, it is evident that the objects of the invention are obtained. Although the invention has been described and illustrated in detail, it is to be clearly understood that the same is by way of illustration and example only. The present invention provides an annular alternator having an annular rotor and annular stator. Although designed specifically for a power source for a fuze, the annular alternator may be used in any other environment.

We wish it to be understood that we do not desire to be limited to the exact detail construction shown and described, for obvious modification can be made by persons skilled in the art.

What is claimed:

1. The combination of a projectile of relatively small diameter and power generating means capable of providing electrical power of at least 15 watts to a circuit of the projectile, the combination comprising;

a stator means secured to a stationary portion of said projectile, said stator comprising an annular coil and a high magnetic permeable toroid surrounding said coil, said toroid having a substantially rectangular cross section at any circumferential portion thereof, two opposed sides of said cross section comprising two continuous annular walls of high permeable magnetic material, a third side of said cross section comprising a third continuous annular wall of high permeable magnetic material which connects said two opposed sides along a first edge of each, and a fourth side of said cross section comprising discontinuous wall portions of high permeable magnetic material spaced about the circumference thereof, said discontinuous wall portions being attached to said two opposed sides of said cross section along a second edge of each said opposed side, alternate discontinuous portions being attached to opposite ones of said opposed sides, rotating means secured to said projectile, impeller means on said rotating means to impart rotary motion thereto in response to air flow over the surface of the projectile, and a rotor on said rotating means comprising an annular keeper composed of high permeable magnetic material, individual permanent magnets embedded in said annular keeper and spaced from one another in a circumferential direction, said magnets each having one pole thereof facing said fourth side of said toroid of said stator, wherein alternate magnets along the circumference of said keeper having opposite poles facing said toroid, whereby rotation of said rotor relative to said stator in response to air flow over the surface of said projectile during flight thereof is sufficient to generate at least 15 watts of electrical power.

2. The combination of claim 1, wherein said fourth side of said toroid is the outermost circumferential wall portion thereof, said two opposed sides are the axially spaced walls of the toroid, said stator and rotor being concentric with respect to one another, and the magnets of said rotor are radially spaced about the circumference of said stator for rotation thereabout.

3. The combination of claim 1, wherein said fourth side of said toroid is one of the axially spaced walls thereof, said two opposed sides are radially spaced from one another said stator and rotor being juxtaposed along the axis of rotation, and the magnets of said rotor are axially spaced from said fourth side of said toroid.

4. The combination of claim 1, wherein said permanent magnets are samarium cobalt magnets.

5. The combination of claim 1, wherein said generating means is capable of generating 20 watts of power in response to rotation of said rotating means.

* * * * *